US011835189B1

(12) United States Patent
Bai et al.

(10) Patent No.: US 11,835,189 B1
(45) Date of Patent: Dec. 5, 2023

(54) WORKING LAMP AND WORKING LAMP GROUP

(71) Applicant: Ningbo Jinghui Opto-Electronic Co., Ltd., Zhejiang Province (CN)

(72) Inventors: Guohui Bai, Zhejiang (CN); Xia Xiao, Zhejiang (CN)

(73) Assignee: NINGBO JINGHUI OPTO-ELECTRONIC CO., LTD.

( * ) Notice: Subject to any disclaimer, the term of this patent is extended or adjusted under 35 U.S.C. 154(b) by 0 days.

(21) Appl. No.: 18/336,738

(22) Filed: Jun. 16, 2023

(30) Foreign Application Priority Data

Apr. 4, 2023 (CN) ..... 202320723322.3

(51) Int. Cl.

| | |
|---|---|
| ***F21S 2/00*** | (2016.01) |
| ***F21V 27/00*** | (2006.01) |
| ***F21V 19/04*** | (2006.01) |
| ***F21V 23/04*** | (2006.01) |
| ***F21V 23/00*** | (2015.01) |
| ***F21V 29/74*** | (2015.01) |

(52) U.S. Cl.
CPC ..... *F21S 2/005* (2013.01); *F21V 19/04* (2013.01); *F21V 23/002* (2013.01); *F21V 23/0428* (2013.01); *F21V 27/005* (2013.01); *F21V 29/745* (2015.01)

(58) Field of Classification Search
CPC .. F21V 23/002; F21V 23/0428; F21V 29/745; F21V 19/04; F21V 27/005; F21S 2/005
See application file for complete search history.

(56) References Cited

U.S. PATENT DOCUMENTS

| | | | | |
|---|---|---|---|---|
| 10,429,013 | B1 * | 10/2019 | Fang | F21L 2/00 |
| 2009/0168422 | A1 * | 7/2009 | Chiu | F21V 21/30 362/249.03 |
| 2013/0271993 | A1 * | 10/2013 | Jan | F21V 14/02 362/249.1 |
| 2018/0202639 | A1 * | 7/2018 | Kao | F21V 21/30 |

* cited by examiner

*Primary Examiner* — Matthew J. Peerce
(74) *Attorney, Agent, or Firm* — FOLEY & LARDNER LLP

(57) ABSTRACT

The present invention discloses a working lamp, including a working lamp housing, a working lamp lighting assembly, and a working lamp power supply system, where a working lamp connecting portion is provided on an outer wall of the working lamp housing, and the working lamp housing is detachably connected to other working lamps by means of the working lamp connecting portion. The working lamp provided by the present invention is provided with the working lamp connecting portion on the outer wall of the working lamp housing, which allows the working lamp to be detachably connected to the other working lamps by means of the working lamp connecting portion, so that a user can easily connect the working lamp to the other working lamps, and the illumination range is expanded accordingly. The working lamp is convenient to use. The present invention also provides a working lamp group.

7 Claims, 6 Drawing Sheets

WORKING LAMP AND WORKING LAMP GROUP

CROSS-REFERENCE TO RELATED PATENT APPLICATIONS

This application claims priority to and the benefit of Chinese Patent Application No. 202320723322.3, filed Apr. 4, 2023, the entire disclosure of which, including the specification, drawings, claims, and abstract, is incorporated herein by reference in its entirety.

BACKGROUND

The present invention relates to the field of working lamps, in particular to an easy-to-expand working lamp and a working lamp group.

Working lamps are a common type of lighting fixture, which are used for providing light for users in environments with insufficient light to facilitate their activities. The working lamp is generally composed of an optical component, a mechanical component, an electrical component, and the like.

Due to limitations in its own structure and body shape, a single working lamp is limited in its illumination range to a certain extent; and when the single working lamp cannot meet the practical needs of users, a plurality of working lamps will be used to expand the illumination range. In the prior art, it is usually necessary to use a tripod, which is equipped with a plurality of connecting structures for connecting with working lamps, and the plurality of working lamps are fixed to the tripod by means of the connecting structures. The above structure requires a user to purchase the additional tripod, and is inconvenient to use.

SUMMARY

An exemplary embodiment relates to a working lamp that includes a working lamp housing, a working lamp lighting assembly arranged inside the working lamp housing; and a working lamp power supply system used for supplying energy for the working lamp lighting assembly. A working lamp connecting portion is provided on an outer wall of the working lamp housing, and the working lamp housing is detachably connected to other working lamps by means of the working lamp connecting portion.

Another exemplary embodiment relates to a working lamp group, the working lamp group including a working main lamp and at least one working expansion lamp for expanding the working main lamp. The working main lamp includes a main lamp housing, a main lamp lighting assembly arranged inside the main lamp housing, and a main lamp power supply system used for supplying energy for the main lamp lighting assembly.

Figure 1:
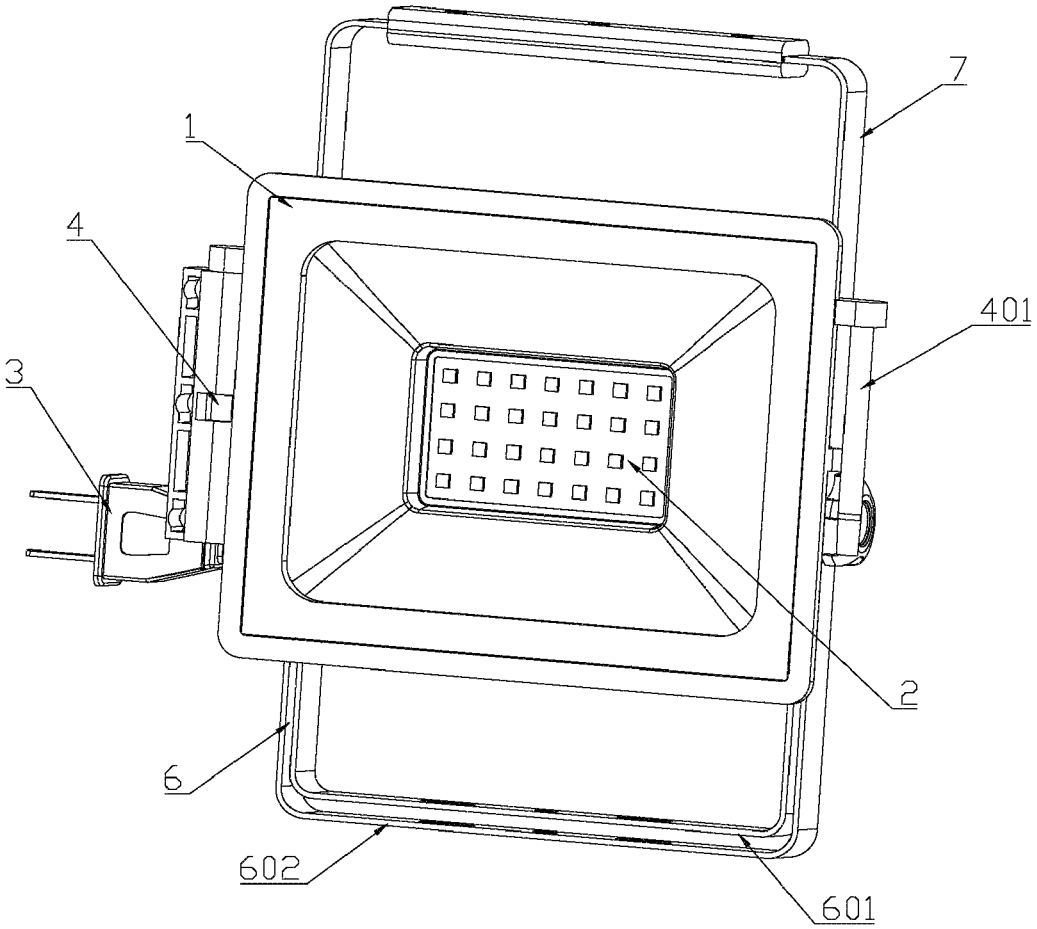
FIG. 1 is a schematic diagram of the three-dimensional structure of a working lamp provided by the present invention.

The following reference numerals on the drawings are described below: 1 denotes a working lamp housing; 2 denotes a working lamp lighting assembly; 3 denotes a working lamp power supply system; 4 denotes a working lamp connecting portion; 401 denotes a first connecting portion; 4011 denotes a connecting block; 4012 denotes a connecting rotation shaft; 4012*a* denotes a first guide surface; 4013 denotes a limiting block; 4013*a* denotes a first limiting portion; 4013*b* denotes a second limiting portion; 402 denotes a second connecting portion; 4021 denotes a connecting cylinder; 4021*a* denotes a first connecting cylinder; 4021*b* denotes a second connecting cylinder; 4021*c* denotes an entry opening; 4021*d* denotes a second guide surface; 4022 denotes a rotation shaft hole; 4022*a* denotes a first rotation shaft hole; 4022*b* denotes a second rotation shaft hole; 4023 denotes a limiting gap; 5 denotes a working lamp control switch; 6 denotes a first frame body; 601 denotes a first holder; 602 denotes a second holder; 7 denotes a first handle; 8 denotes a first heat dissipation device; 9 denotes a connecting structures; 901 denotes first adjusting screw holes; 902 denotes first adjusting bolts; 10 denotes a working main lamp; 1001 denotes a main lamp housing; 1002 denotes a main lamp lighting assembly; 1003 denotes a main lamp power supply system; 10031 denotes a main lamp input terminal; 1004 denotes energy supply output terminals; 1005 denotes a main lamp control switch; 1006 denotes a second frame body; 10061 denotes a base connecting piece; 10062 denotes a base; 1007 denotes second adjusting screw holes; 1008 denotes second adjusting bolts; 1009 denotes a third adjusting bolt; 10010 denotes a second handle; 10011 denotes a second heat dissipation device; 10012 denotes cable fixing pieces; 11 denotes working expansion lamps; 1101 denotes working lamp input terminals; 1102 denotes cable storage pieces; 1103 denotes power cables; and 12 denotes a mains supply output terminal.

DETAILED DESCRIPTION

In order to overcome the shortcomings in the prior art, the present invention provides a working lamp, and a working lamp connecting portion is arranged on an outer wall of a working lamp housing, which allows the working lamp to be detachably connected to other working lamps by means of the working lamp connecting portion, so that a user can easily connect the working lamp to the other working lamps, and the illumination range is expanded accordingly. The working lamp is simple in structure and convenient to use. The present invention also provides a working lamp group.

In order to achieve the above purposes, the present invention is realized by adopting the following technical solution.

A working lamp includes a working lamp housing, a working lamp lighting assembly arranged inside the working lamp housing, and a working lamp power supply system used for supplying energy for the working lamp lighting assembly, where a working lamp connecting portion is provided on an outer wall of the working lamp housing, and the working lamp housing is detachably connected to other working lamps by means of the working lamp connecting portion.

With the above structure, the working lamp power supply system supplies power to the working lamp lighting assembly so as to allow the working lamp lighting assembly to be capable of working independently; and due to the arrangement of the working lamp connecting portion, the working lamp can be detachably connected to the other working lamps. When a user uses the working lamp or the other working lamps alone and feels that the lighting range of the working lamp or the other working lamps cannot meet the usage requirement, the working lamp can be connected to the other working lamps by means of the working lamp connecting portion of the working lamp, so that the lighting range of the other working lamps is expanded via the working lamp, or the lighting range of the working lamp is expanded via the other working lamps.

Further, the working lamp connecting portion includes a first connecting portion connected to the working lamp housing and a second connecting portion for connection with the other working lamps; and the first connecting portion is detachably connected to the second connecting portion.

With the above structure, since the first connecting portion is detachably connected to the second connecting portion, a detachable connection between the working lamp and the other working lamps is realized.

Further, the first connecting portion is detachably connected to the working lamp housing, and specifically, the detachable connection between the first connecting portion and the working lamp housing is realized by means of bolts; or the first connecting portion is fixedly connected to the working lamp housing, that is, the first connecting portion and the working lamp housing form a non-detachable integrated arrangement; the second connecting portion is detachably connected to the other working lamps, and specifically, the detachable connection between the second connecting portion and housings of the other working lamps is realized by means of bolts; or the second connecting portion is fixedly connected to the other working lamps, that is, the second connecting portion and the housings of the other working lamps form a non-detachable integrated arrangement.

Further, the first connecting portion is rotatably connected to the second connecting portion.

With the above structure, the rotatable connection between the first connecting portion and the second connecting portion allows the working lamp to be rotated relative to the other working lamps, thus realizing the adjustment of an angle between a light-emitting direction of the working lamp and light-emitting directions of the other working lamps, and adapting to the different usage requirements of users.

In some embodiments, the working lamp connecting portion adopts a clamping structure to clamp the other working lamps so as to achieve a detachable connection between the working lamp and the other working lamps.

Further, in some embodiments, the first connecting portion includes a connecting block connected to the working lamp housing, and a connecting rotation shaft arranged on the connecting block; the second connecting portion includes a connecting cylinder having a rotation shaft hole; and the connecting rotation shaft is matched with the rotation shaft hole to penetrate into the rotation shaft hole.

With the above structure, the connecting rotation shaft is fitted to the rotation shaft hole in an inserting manner to realize the detachable connection between the first connecting portion and the second connecting portion, and the connecting rotation shaft is rotationally fitted to the rotation shaft hole to realize the rotatable connection between the first connecting portion and the second connecting portion.

Further, the connecting cylinder includes a first connecting cylinder having a first rotation shaft hole and a second connecting cylinder having a second rotation shaft hole; the first connecting cylinder and the second connecting cylinder are spaced apart to form a limiting gap, and the first rotation shaft hole and the second rotation shaft hole are reserved in a coaxial manner to form the rotation shaft hole; an entry opening is reserved on a side wall of the first connecting cylinder; the entry opening runs through the height of the first connecting cylinder in the height direction, and communicates with a connecting hole of the first connecting rotation shaft (e.g., a rotation shaft hole) in the depth direction; the two opposite sides of the entry opening can be close to and away from each other to adjust the opening size, and the opening size of the entry opening is smaller than the diameter of the connecting rotation shaft under normal conditions; and a limiting block is arranged on a side wall of the connecting rotation shaft, the thickness of the limiting block matches the limiting gap, and the widths of at least some parts of the limiting block are greater than the opening size of the entry opening under normal conditions.

With the above structure, during assembly, the end of the connecting rotation shaft away from the connecting block is pre-inserted into the second rotation shaft hole, that is, the end of the connecting rotation shaft away from the connecting block abuts against the second rotation shaft hole and forms an angle with the second rotation shaft hole; the two opposite ends of the entry opening are away from each other, so that the end of the connecting rotation shaft close to the connecting block enters the first rotation shaft hole; and after the end of the connecting rotation shaft close to the connecting block completely enters the first rotation shaft hole, the two opposite ends of the entry opening are close to each other to restore a normal state, and the end of the connecting rotation shaft away from the connecting block completely enters the second rotation shaft hole. At this time, the end of the connecting rotation shaft close to the connecting block is rotationally fitted to the first rotation shaft hole, and the end of the connecting rotation shaft away from the connecting block is rotationally fitted to the second rotation shaft hole; the limiting block is located at the limiting gap between the first connecting cylinder and the second connecting cylinder, and the limiting block is matched with a bottom surface of the first connecting cylinder and a top surface of the second connecting cylinder to limit the axial movement of the connecting rotation shaft, so that the connecting rotation shaft and the connecting cylinder will not be accidentally separated; during disassembly, the operation is carried out in a reverse order; specifically, the first connecting cylinder relies on material properties to make itself have a certain elasticity such as plasticity, which allows the two opposite sides of the entry opening to be close to or away from each other, so that the opening size of the entry opening can be adjusted; and under normal conditions, the two opposite sides of the entry opening are close to each other.

Further, the limiting block is connected to the working lamp housing.

With the above structure, the connecting rotation shaft and the working lamp housing are connected and fixed again by the limiting block, so that the connecting rotation shaft can be more stably fixed on the working lamp housing.

Further, the limiting block includes a first limiting portion and a second limiting portion, where one end of the first limiting portion is connected to the side wall of the connecting rotation shaft, and the other end of the first limiting portion is connected to the second limiting portion; and the width of the first limiting portion is not greater than the opening size of the entry opening under normal conditions, and the width of the second limiting portion is greater than the opening size of the entry opening under normal conditions.

With the above structure, the second limiting portion is used for limiting the axial movement of the connecting rotation shaft, and the arrangement of the first limiting portion makes the disassembly between the connecting rotation shaft and the connecting cylinder more convenient.

Further, along the direction from the end of the connecting rotation shaft connected to the connecting block to the end of the connecting rotation shaft away from the connecting block, the side wall at the end of the connecting rotation shaft away from the connecting block is obliquely closed up towards the axis of the connecting rotation shaft to form a first guide surface.

With the above structure, during the installation of the connecting rotation shaft, the first guide surface is provided to facilitate the insertion of the connecting rotation shaft into the entry opening to act on both sides of the entry opening, thus causing the two sides of the entry opening to be away from each other, and facilitating the entry of the connecting rotation shaft into the first rotation shaft hole.

Further, along the direction from the end of the entry opening close to the second connecting cylinder to the end of the entry opening away from the second connecting cylinder, the two opposite sides of the end of the entry opening away from the second connecting cylinder gradually get away from each other and tilt to form a second guide surface.

With the above structure, during the installation of the connecting rotation shaft, the second guide surface is provided to facilitate the insertion of the connecting rotation shaft into the entry opening to act on both sides of the entry opening, thus causing the two sides of the entry opening to be away from each other, and facilitating the entry of the connecting rotation shaft into the first rotation shaft hole.

Further, the working lamp includes a working lamp control switch, and the working lamp control switch is connected to the working lamp lighting assembly to control the working state of the working lamp lighting assembly.

With the above structure, the user can control the on and off of the working lamp lighting assembly by means of the working lamp control switch when using the working lamp.

Further, the working lamp includes a first frame body for supporting the working lamp, and the first frame body includes a first holder and a second holder, where the first holder and the second holder are separately hinged to the working lamp housing.

With the above structure, when in use, the first holder and the second holder are rotated, which allows a stable triangular structure to be formed by the first holder, the second holder and a placement surface, so that the working lamp can stand firmly on the placement surface; and of course, the user can adjust the angle of the light-emitting direction of the working lamp by adjusting the angles of the first holder and the second holder.

Specifically, the first holder and the second holder are hinged to the working lamp housing by the same connecting structures; more specifically, the first holder is in a U-shaped structure, the second holder is in a U-shaped structure, the two ends of the first holder are respectively hinged to the two sides of the working lamp housing by the connecting structures, and the two ends of the second holder are respectively hinged to the two sides of the working lamp housing by the connecting structures; the circumference of the first holder is smaller than that of the second holder; each of the connecting structures includes first adjusting screw holes respectively reserved on both sides of the working lamp housing, and two first adjusting bolts matched with the first adjusting screw holes; the first adjusting bolts respectively pass through through holes reserved on both ends of the first holder and the second holder and then are screwed into the corresponding first adjusting screw holes; and when in use, the user rotates the first adjusting bolts to loose and tighten the first holder and the second holder so as to achieve adjustment and stabilization.

Further, the working lamp includes a first handle for holding the working lamp, and the first handle is hinged to the working lamp housing.

With the above structure, the first handle is convenient for the user to hold the working lamp; and specifically, the first handle is connected to the second holder, and the first handle is in a U-shaped structure, that is, the first handle and the second holder are integrally in a square-shaped structure.

Further, a first heat dissipation device is arranged on the outer side of the working lamp housing.

With the above structural surface, the first heat dissipation device improves the heat dissipation performance of the working lamp. Specifically, the working lamp lighting assembly abuts against the inner surface of the working lamp housing, the first heat dissipation device is disposed at a position corresponding to the abutting position of the working lamp lighting assembly, and the first heat dissipation device is composed of heat dissipation fins.

A working lamp group includes a working main lamp and at least one working expansion lamp for expanding the working main lamp, where the working main lamp includes a main lamp housing, a main lamp lighting assembly arranged inside the main lamp housing, and a main lamp power supply system used for supplying energy for the main lamp lighting assembly; and the above working lamp is employed as the working expansion lamp, and the working main lamp is formed into the other working lamps.

With the above structure, the working main lamp and the working expansion lamp are not only used separately, but also when the illumination range of the working main lamp cannot meet the usage requirements of the user, the working expansion lamp can be installed on the working main lamp by means of the working lamp connecting portion.

Further, the working main lamp includes an energy supply output terminal used for providing electric energy for the working expansion lamp, and the energy supply output terminal is electrically connected to the main lamp power supply system to obtain electric energy; and the working lamp power supply system in the working expansion lamp includes a working lamp input terminal which can be electrically connected to the energy supply output terminal to obtain electric energy.

With the above structure, the working expansion lamp can be electrically connected to the energy supply output terminal on the working main lamp by means of the working lamp input terminal provided thereon, so that the working expansion lamp can obtain electricity from the working main lamp.

Further, the main lamp power supply system includes a main lamp input terminal; the main lamp input terminal can be matched with and electrically connected to a mains supply output terminal connected to a mains supply to obtain electrical energy; and the working lamp input terminal can be matched with and electrically connected to the mains supply output terminal connected to the mains supply to obtain electrical energy.

With the above structure, the working main lamp obtains electricity through the electrical connection between the main lamp input terminal and the mains supply output terminal; the working expansion lamp can not only obtain electricity from the working main lamp, but also can obtain electricity through the electrical connection between the working lamp input terminal and the mains supply output terminal; and specifically, the mains supply output terminal adopts a socket structure, the main lamp input terminal adopts a plug structure, the working lamp input terminal adopts a plug structure, and the energy supply output terminal adopts a jack structure.

Further, the two working expansion lamps may be provided and are respectively arranged on both sides of the working main lamp.

With the above structure, since the two working expansion lamps are provided, the illumination range of the working main lamp can be further expanded; the user can select the number of the working expansion lamps to be installed according to his or her own usage requirements, which expands the range of usage of the working lamp group; and correspondingly, the two energy supply output terminals are available.

Specifically, the second connecting portions are respectively provided on both sides of the working main lamp so as to facilitate the installation of the working expansion lamps on both sides the working main lamp. The first connecting portions are respectively provided on both sides of each of the working expansion lamps so as to allow the working expansion lamps to be installed at the left or right side of the working main lamp at will.

Further, the working main lamp includes a main lamp control switch, and the main lamp control switch is connected to the main lamp lighting assembly to control the working state of the main lamp lighting assembly.

With the above structure, the user can control the on and off of the main lamp lighting assembly by means of the main lamp control switch when using the working main lamp.

Further, the working main lamp includes a second frame body for supporting the working main lamp, and the second frame body includes a base connecting piece and a base, where the base connecting piece is hinged to the working main lamp, and the base is arranged on the base connecting piece.

With the above structure, when in use, the working main lamp is made to stand on the placement surface by means of the base; and the angle of the light-emitting direction of the working main lamp is adjusted by rotating the base connecting piece.

Specifically, the base connecting piece is in a U-shaped structure, and the two ends of the base connecting piece are respectively hinged to the two sides of the working main lamp; more specifically, two second adjusting screw holes and two second adjusting bolts matched with the second adjusting screw holes are respectively provided on the two sides of the working main lamp; the second adjusting bolts respectively pass through through holes reserved on both ends of the base connecting piece and then are screwed into the corresponding second adjusting screw holes; and when in use, the user rotates the second adjusting bolts to loose and tighten the base connecting piece so as to achieve adjustment and stabilization.

The base connecting piece is fixed to the base by means of a third adjusting bolt, which enables the user to adjust the rotation angle between the base and the base connecting piece by adjusting the degree of tightness of the third adjusting bolt, thus achieving the light-emitting direction of the working main lamp.

Further, the working main lamp includes a second handle for holding the working lamp.

With the above structure, the second handle is convenient for the user to hold the working main lamp; and specifically, the second handle is in a U-shaped structure, and two ends of the second handle are connected to the working main lamp.

Further, a second heat dissipation device is arranged on the outer side of the main lamp housing.

With the above structural surface, the second heat dissipation device improves the heat dissipation performance of the working main lamp. Specifically, the main lamp lighting assembly abuts against the inner surface of the main lamp housing, the second heat dissipation device is disposed at a position corresponding to the abutting position of the main lamp lighting assembly, and the second heat dissipation device is composed of heat dissipation fins.

Further, cable storage pieces are arranged on the outer sides of the working lamp housings of the working expansion lamps; the two cable storage pieces are arranged opposite to each other on both sides of the back sides of the working lamp housings of the working expansion lamps; the cable storage pieces are convenient for storing power cables connected to the working lamp input terminals; cable fixing pieces are arranged on the outer side of the main lamp housing of the working main lamp, and the cable fixing pieces are used for fixing the power cables connected to the working lamp input terminals; and specifically, the two cable fixing pieces are arranged opposite to each other on both sides of the back side of the main lamp housing, and correspond to the two working expansion lamps.

Compared with the prior art, the present invention has the following beneficial effects.

The working lamp provided by the present invention is provided with the working lamp connecting portion on the outer wall of the working lamp housing, which allows the working lamp to be detachably connected to the other working lamps by means of the working lamp connecting portion, so that the user can easily connect the working lamp to the other working lamps, and the illumination range is expanded accordingly; and the working lamp is simple in structure and convenient to use.

The working lamp provided by the present invention is provided with the first connecting portion and the second connecting portion that are rotatably connected, which enables the working lamp to rotate relative to the other working lamps after being connected to the other working lamps, so that the angles of the light-emitting directions of the working lamp and the other working lamps are adjusted, and the different usage requirements of users are met.

According to the working lamp provided by the present invention, the structural arrangement of the first connecting portion and the second connecting portion is reasonable and simple, so that the working lamp is convenient to assemble and disassemble by the user.

According to the working lamp group provided by the present invention, the working main lamp is provided with the energy supply output terminal which can be connected to the working expansion lamp to provide electric energy, thus making the working lamp group convenient to use.

The following is a further detailed description of the specific implementation of the present invention in combination with the accompanying diagrams and embodiments. The following embodiments are used to illustrate the present invention, but are not intended to limit the scope of the present invention.

As shown in FIG. 1 to FIG. 5, a working lamp includes a working lamp housing 1, a working lamp lighting assembly 2 arranged inside the working lamp housing 1, and a working lamp power supply system 3 used for supplying energy for the working lamp lighting assembly 2, where a working lamp connecting portion 4 is provided on an outer wall of the working lamp housing 1, and the working lamp housing 1 is detachably connected to other working lamps by means of the working lamp connecting portion 4.

With the above structure, the working lamp power supply system 3 supplies power to the working lamp lighting assembly 2 so as to allow the working lamp lighting assembly to be capable of working independently; and due to the arrangement of the working lamp connecting portion 4, the working lamp can be detachably connected to the other working lamps. When a user uses the working lamp or the other working lamps alone and feels that the lighting range of the working lamp or the other working lamps cannot meet the usage requirement, the working lamp can be connected to the other working lamps by means of the working lamp connecting portion of the working lamp, so that the lighting range of the other working lamps is expanded via the working lamp, or the lighting range of the working lamp is expanded via the other working lamps.

Further, the working lamp connecting portion 4 includes a first connecting portion 401 connected to the working lamp housing 1 and a second connecting portion 402 for connection with the other working lamps; and the first connecting portion 401 is detachably connected to the second connecting portion 402.

With the above structure, since the first connecting portion 401 is detachably connected to the second connecting portion 402, a detachable connection between the working lamp and the other working lamps is realized.

Further, the first connecting portion 401 is detachably connected to the working lamp housing 1, and specifically, the detachable connection between the first connecting portion 401 and the working lamp housing 1 is realized by means of bolts; or the first connecting portion 401 is fixedly connected to the working lamp housing 1, that is, the first connecting portion 401 and the working lamp housing 1 form a non-detachable integrated arrangement; the second connecting portion 402 is detachably connected to the other working lamps, and specifically, the detachable connection between the second connecting portion 402 and housings of the other working lamps is realized by means of bolts; or the second connecting portion 402 is fixedly connected to the other working lamps, that is, the second connecting portion 402 and the housings of the other working lamps form a non-detachable integrated arrangement.

Further, the first connecting portion 401 is rotatably connected to the second connecting portion 402.

With the above structure, the rotatable connection between the first connecting portion 401 and the second connecting portion 402 allows the working lamp to be rotated relative to the other working lamps, thus realizing the adjustment of an angle between a light-emitting direction of the working lamp and light-emitting directions of the other working lamps, and adapting to the different usage requirements of users.

In some embodiments, the working lamp connecting portion 4 adopts a clamping structure to clamp the other working lamps so as to achieve a detachable connection between the working lamp and the other working lamps.

Further, in some embodiments, the first connecting portion 401 includes a connecting block 4011 connected to the working lamp housing 1, and a connecting rotation shaft 4012 arranged on the connecting block 4011; the second connecting portion 402 includes a connecting cylinder 4021 having a rotation shaft hole 4022; and the connecting rotation shaft 4012 is matched with the rotation shaft hole 4022 to penetrate into the rotation shaft hole 4022.

With the above structure, the connecting rotation shaft 4012 is fitted to the rotation shaft hole 4022 in an inserting manner to realize the detachable connection between the first connecting portion 401 and the second connecting portion 402, and the connecting rotation shaft 4012 is rotationally fitted to the rotation shaft hole 4022 to realize the rotatable connection between the first connecting portion 401 and the second connecting portion 402.

Figure 3:
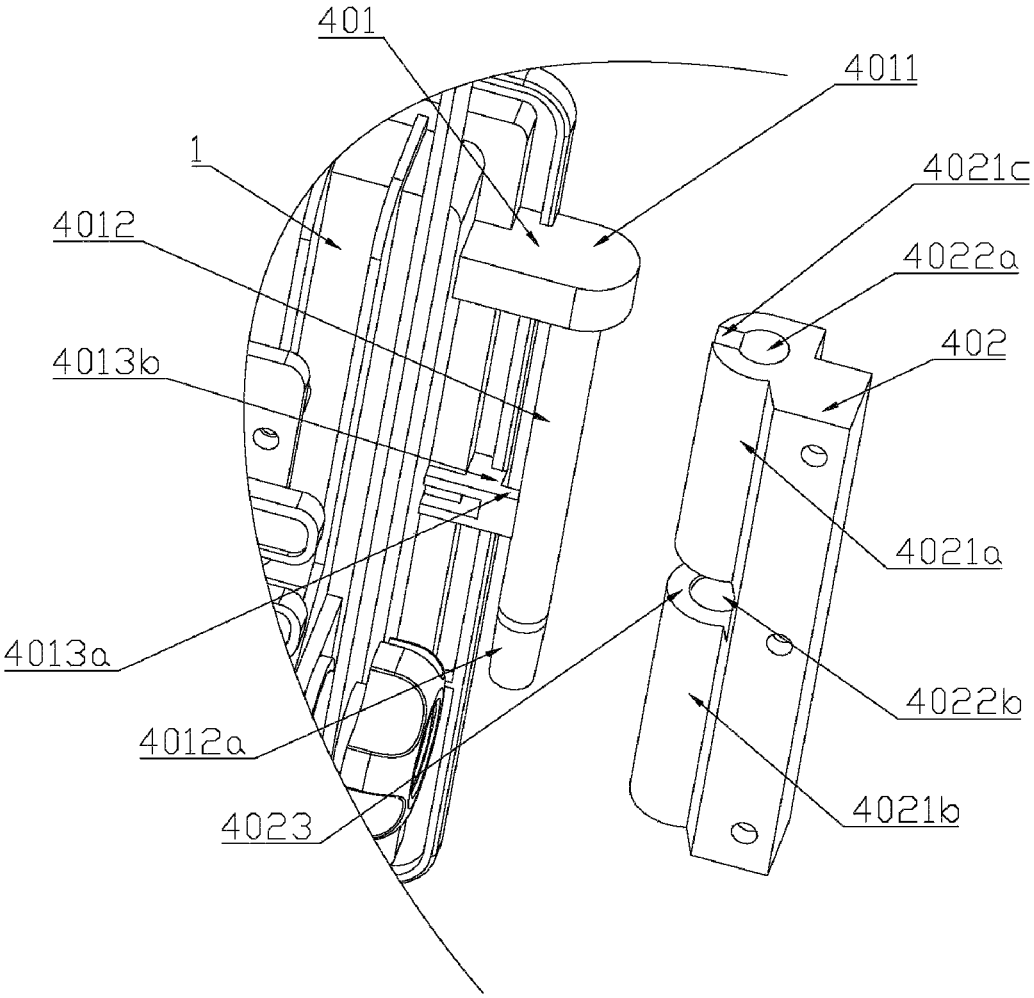
FIG. 3 is a schematic diagram of the structure of a working lamp connecting portion in a working lamp provided by the present invention.
Figure 4:
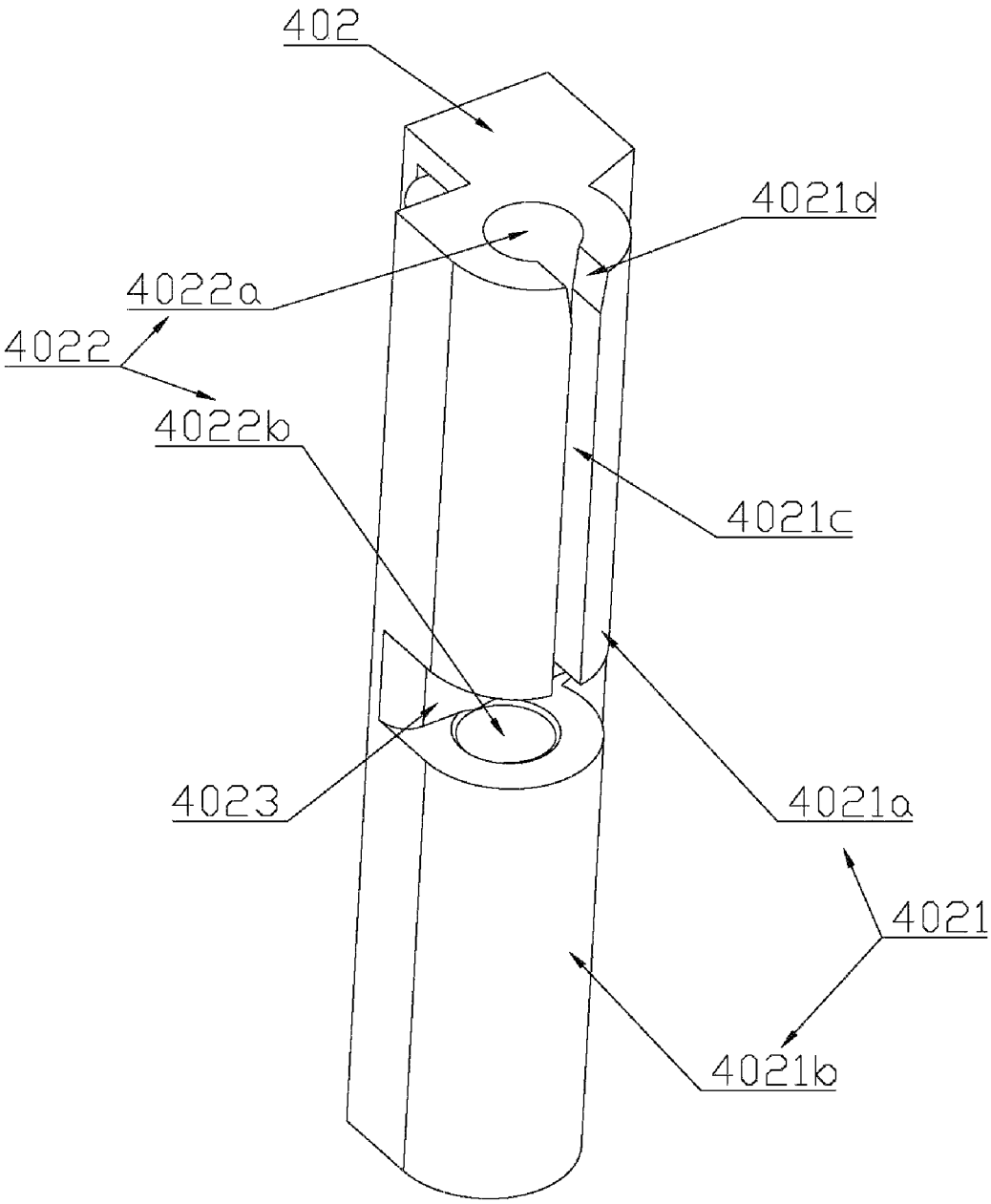
FIG. 4 is a schematic diagram of the structure of a second connecting portion in a working lamp provided by the present invention.

As shown in FIG. 3 and FIG. 4, further, the connecting cylinder 4021 includes a first connecting cylinder 4021*a* having a first rotation shaft hole 4022*a* and a second connecting cylinder 4021*b* having a second rotation shaft hole 4022*b*; the first connecting cylinder 4021*a* and the second connecting cylinder 4021*b* are spaced apart to form a limiting gap 4023, and the first rotation shaft hole 4022*a* and the second rotation shaft hole 4022*b* are reserved in a coaxial manner to form the rotation shaft hole 4022; an entry opening 4021*c* is reserved on a side wall of the first connecting cylinder 4021*a*; the entry opening 4021*c* runs through the height of the first connecting cylinder 4021*a* in the height direction, and communicates with a connecting hole of the first connecting rotation shaft 4012 (e.g., the first rotation shaft hole 4022*a*) in the depth direction; the two opposite sides of the entry opening 4021*c* can be close to and away from each other to adjust the opening size, and the opening size of the entry opening 4021*c* is smaller than the diameter of the connecting rotation shaft 4012 under normal conditions; and a limiting block 4013 is arranged on a side wall of the connecting rotation shaft 4012, the thickness of the limiting block 4013 matches the limiting gap 4023, and the widths of at least some parts of the limiting block 4013 are greater than the opening size of the entry opening 4021*c* under normal conditions.

With the above structure, during assembly, the end of the connecting rotation shaft 4012 away from the connecting block 4011 is pre-inserted into the second rotation shaft hole 4022*b*, that is, the end of the connecting rotation shaft 4012 away from the connecting block 4011 abuts against the second rotation shaft hole 4022*b* and forms an angle with the second rotation shaft hole 4022*b*; the two opposite ends of the entry opening 4021*c* are away from each other, so that the end of the connecting rotation shaft 4012 close to the connecting block 4011 enters the first rotation shaft hole 4022*a*; and after the end of the connecting rotation shaft 4012 close to the connecting block 4011 completely enters the first rotation shaft hole 4022*a*, the two opposite ends of the entry opening 4021*c* are close to each other to restore a normal state, and the end of the connecting rotation shaft 4012 away from the connecting block 4011 completely enters the second rotation shaft hole 4022*b*. At this time, the end of the connecting rotation shaft 4012 close to the connecting block is rotationally fitted to the first rotation shaft hole 4022*a*, and the end of the connecting rotation shaft 4012 away from the connecting block 4011 is rotationally fitted to the second rotation shaft hole 4022*b*; the limiting block 4013 is located at the limiting gap 4023 between the first connecting cylinder 4021*a* and the second connecting cylinder 4021*b*, and the limiting block 4013 is matched with a bottom surface of the first connecting cylinder 4021*a* and a top surface of the second connecting cylinder 4021*b* to limit the axial movement of the connecting rotation shaft 4012, so that the connecting rotation shaft 4012 and the connecting cylinder 4021 will not be accidentally separated; during disassembly, the operation is carried out in a reverse order; specifically, the first connecting cylinder 4021*a* relies on material properties to make itself have a certain elasticity such as plasticity, which allows the two opposite sides of the entry opening 4021*c* to be close to or away from each other, so that the opening size of the entry opening can be adjusted; and under normal conditions, the two opposite sides of the entry opening 4021*c* are close to each other.

Further, the limiting block 4013 is connected to the working lamp housing 1.

With the above structure, the connecting rotation shaft 4012 and the working lamp housing 1 are connected and fixed again by the limiting block 4013, so that the connecting rotation shaft 4012 can be more stably fixed on the working lamp housing 1.

Further, the limiting block 4013 includes a first limiting portion 4013*a* and a second limiting portion 4013*b*, where one end of the first limiting portion 4013*a* is connected to the side wall of the connecting rotation shaft 4012, and the other end of the first limiting portion is connected to the second limiting portion 4013*b*; and the width of the first limiting portion 4013*a* is not greater than the opening size of the entry opening 4021*c* under normal conditions, and the width of the second limiting portion 4013*b* is greater than the opening size of the entry opening 4021*c* under normal conditions.

With the above structure, the second limiting portion 4013*b* is used to limit the axial movement of the connecting rotation shaft 4012, and the arrangement of the first limiting portion 4013*a* makes the disassembly between the connecting rotation shaft 4012 and the connecting cylinder 4021 more convenient.

Further, along the direction from the end of the connecting rotation shaft 4012 connected to the connecting block 4011 to the end of the connecting rotation shaft 4012 away from the connecting block 4011, the side wall at the end of the connecting rotation shaft 4012 away from the connecting block 4011 is obliquely closed up towards the axis of the connecting rotation shaft 4012 to form a first guide surface 4012*a*.

With the above structure, during the installation of the connecting rotation shaft 4012, the first guide surface 4012*a* is provided to facilitate the insertion of the connecting rotation shaft 4012 into the entry opening 4021*c* to act on both sides of the entry opening 4021*c*, thus causing the two sides of the entry opening 4021*c* to be away from each other, and facilitating the entry of the connecting rotation shaft 4012 into the first rotation shaft hole 4022*a*.

Further, along the direction from the end of the entry opening 4021*c* close to the second connecting cylinder 4021*b* to the end of the entry opening 4021*c* away from the second connecting cylinder 4021*b*, the two opposite sides of the end of the entry opening 4021*c* away from the second connecting cylinder 4021*b* gradually get away from each other and tilt to form a second guide surface 4021*d*.

With the above structure, during the installation of the connecting rotation shaft 4012, the second guide surface 4021*d* is provided to facilitate the insertion of the connecting rotation shaft 4012 into the entry opening 4021*c* to act on both sides of the entry opening 4021*c*, thus causing the two sides of the entry opening 4021*c* to be away from each other, and facilitating the entry of the connecting rotation shaft 4012 into the first rotation shaft hole 4022*a*.

Further, the working lamp includes a working lamp control switch 5, and the working lamp control switch 5 is connected to the working lamp lighting assembly 2 to control the working state of the working lamp lighting assembly 2.

With the above structure, the user can control the on and off of the working lamp lighting assembly 2 by means of the working lamp control switch 5 when using the working lamp.

Figure 2:
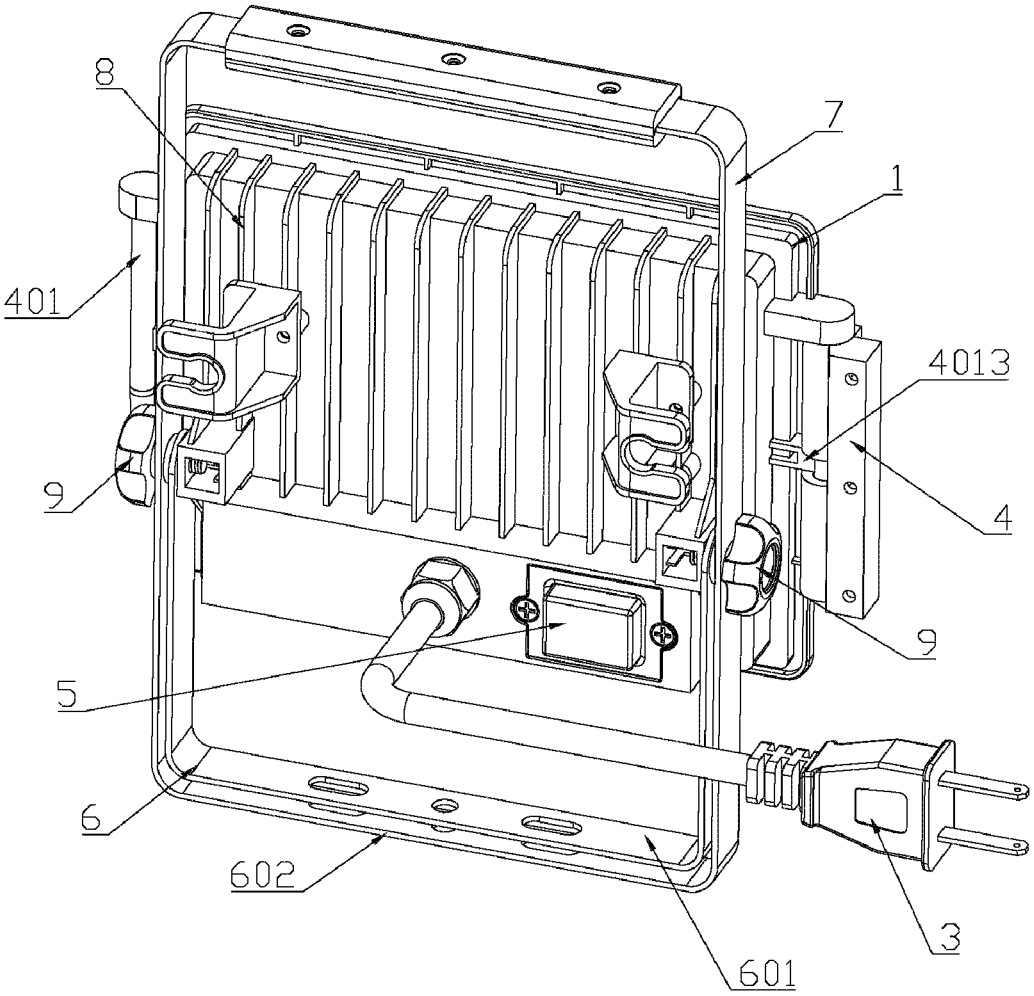
FIG. 2 is a schematic diagram of the three-dimensional structure of a working lamp provided by the present invention from another angle.
Figure 5:
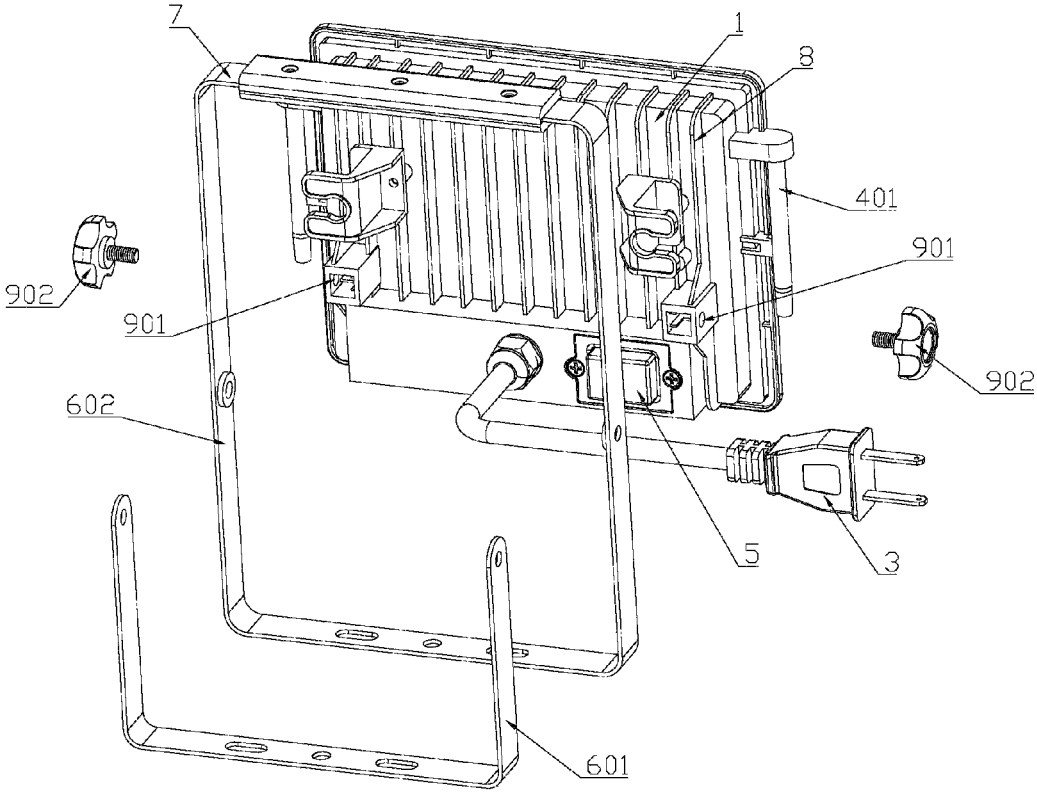
FIG. 5 is a schematic diagram of the partially exploded structure of a working lamp provided by the present invention.
Figure 6:
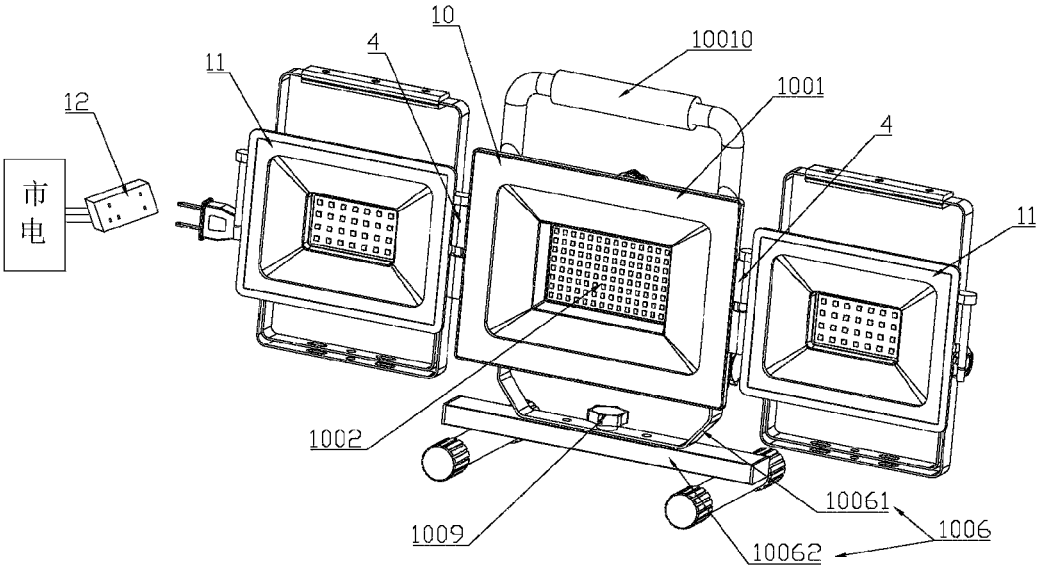
FIG. 6 is a schematic diagram of the three-dimensional structure of a working lamp group provided by the present invention.
Figure 7:
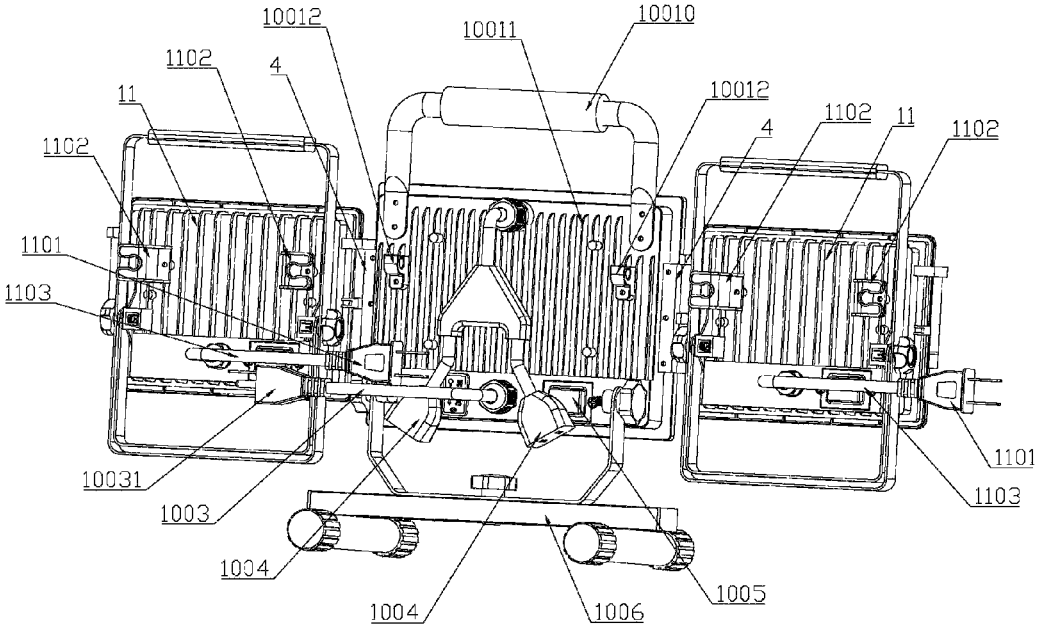
FIG. 7 is a schematic diagram of the three-dimensional structure of a working lamp group provided by the present invention from another angle.
Figure 8:
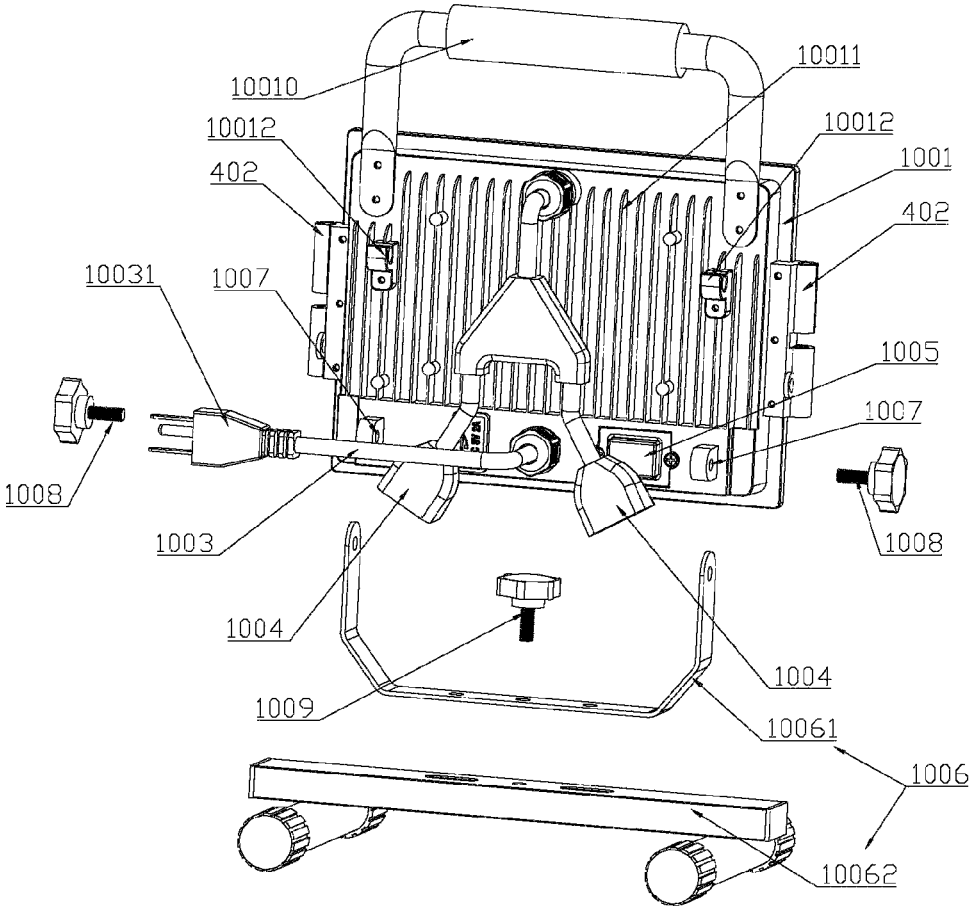
FIG. 8 is a schematic diagram of the partially exploded structure of a working main lamp in a working lamp group provided by the present invention.

As shown in FIG. 1, FIG. 2 and FIG. 5, further, the working lamp includes a first frame body 6 for supporting the working lamp, and the first frame body 6 includes a first holder 601 and a second holder 602, where the first holder 601 and the second holder 602 are separately hinged to the working lamp housing 1.

With the above structure, when in use, the first holder 601 and the second holder 602 are rotated, which allows a stable triangular structure to be formed by the first holder 601, the second holder 602 and a placement surface, so that the working lamp can stand firmly on the placement surface; and of course, the user can adjust the angle of the light-emitting direction of the working lamp by adjusting the angles of the first holder 601 and the second holder 602.

Specifically, the first holder 601 and the second holder 602 are hinged to the working lamp housing 1 by the same connecting structures 9; more specifically, the first holder 601 is in a U-shaped structure, the second holder 602 is in a U-shaped structure, the two ends of the first holder 601 are respectively hinged to the two sides of the working lamp housing 1 by the connecting structures 9, and the two ends of the second holder 602 are respectively hinged to the two sides of the working lamp housing 1 by the connecting structures 9; the circumference of the first holder 601 is smaller than that of the second holder 602; each of the connecting structures 9 includes first adjusting screw holes 901 respectively reserved on both sides of the working lamp housing 1, and two first adjusting bolts 902 matched with the first adjusting screw holes 901; the first adjusting bolts 902 respectively pass through through holes reserved on both ends of the first holder 601 and the second holder 602 and then are screwed into the corresponding first adjusting screw holes 901; and when in use, the user rotates the first adjusting bolts 902 to loose and tighten the first holder 601 and the second holder 602 so as to achieve adjustment and stabilization.

Further, the working lamp includes a first handle 7 for holding the working lamp, and the first handle 7 is hinged to the working lamp housing 1.

With the above structure, the first handle 7 is convenient for the user to hold the working lamp; and specifically, the first handle 7 is connected to the second holder 602, and the first handle 7 is in a U-shaped structure, that is, the first handle 7 and the second holder 602 are integrally in a square-shaped structure.

Further, a first heat dissipation device 8 is arranged on the outer side of the working lamp housing 1.

With the above structural surface, the first heat dissipation device 8 improves the heat dissipation performance of the working lamp. Specifically, the working lamp lighting assembly 2 abuts against the inner surface of the working lamp housing 1, the first heat dissipation device 8 is disposed at a position corresponding to the abutting position of the working lamp lighting assembly 2, and the first heat dissipation device 8 is composed of heat dissipation fins.

As shown in FIG. 1 to FIG. 8, a working lamp group includes a working main lamp 10 and at least one working expansion lamp 11 for expanding the working main lamp 10, where the working main lamp 10 includes a main lamp housing 1001, a main lamp lighting assembly 1002 arranged inside the main lamp housing 1001, and a main lamp power supply system 1003 used for supplying energy for the main lamp lighting assembly 1002; and the above working lamp is employed as the working expansion lamp 11, and the working main lamp 10 is formed into the other working lamps.

With the above structure, the working main lamp 10 and the working expansion lamp 11 are not only used separately, but also when the illumination range of the working main lamp 10 cannot meet the usage requirements of the user, the working expansion lamp 11 can be installed on the working main lamp 10 by means of the working lamp connecting portion 4.

Further, the working main lamp 10 includes an energy supply output terminal 1004 used to provide electric energy for the working expansion lamp 11, and the energy supply output terminal 1004 is electrically connected to the main lamp power supply system 1003 to obtain electric energy; and the working lamp power supply system 3 in the working expansion lamp 11 includes a working lamp input terminal 1101 which can be electrically connected to the energy supply output terminal 1004 to obtain electric energy.

With the above structure, the working expansion lamp 11 can be electrically connected to the energy supply output terminal 1004 on the working main lamp 10 by means of the working lamp input terminal 1101 provided thereon, so that the working expansion lamp 11 can obtain electricity from the working main lamp 10.

Further, the main lamp power supply system 1003 includes a main lamp input terminal 10031; the main lamp input terminal 10031 can be matched with and electrically connected to a mains supply output terminal 12 connected to a mains supply to obtain electrical energy; and the working lamp input terminal 1101 can be matched with and electrically connected to the mains supply output terminal 12 connected to the mains supply to obtain electrical energy.

With the above structure, the working main lamp 10 obtains electricity through the electrical connection between the main lamp input terminal 10031 and the mains supply output terminal 12; the working expansion lamp 11 can not only obtain electricity from the working main lamp 10, but also can obtain electricity through the electrical connection between the working lamp input terminal 1101 and the mains supply output terminal 12; and specifically, the mains supply output terminal 12 adopts a socket structure, the main lamp input terminal 10031 adopts a plug structure, the working lamp input terminal 1101 adopts a plug structure, and the energy supply output terminal 1004 adopts a jack structure.

Further, the two working expansion lamps 11 may be provided and are respectively arranged on both sides of the working main lamp 10.

With the above structure, since the two working expansion lamps 11 are provided, the illumination range of the working main lamp 10 can be further expanded; the user can select the number of the working expansion lamps 11 to be installed according to his or her own usage requirements, which expands the range of usage of the working lamp group; and correspondingly, the two energy supply output terminals 1004 are available.

Specifically, the second connecting portions 402 are respectively provided on both sides of the working main lamp 10 so as to facilitate the installation of the working expansion lamps 11 on both sides the working main lamp. The first connecting portions 401 are respectively provided on both sides of each of the working expansion lamps 11 so as to allow the working expansion lamps 11 to be installed at the left or right side of the working main lamp 10 at will.

Further, the working main lamp 10 includes a main lamp control switch 1005, and the main lamp control switch 1005 is connected to the main lamp lighting assembly 1002 to control the working state of the main lamp lighting assembly 1002.

With the above structure, the user can control the on and off of the main lamp lighting assembly 1002 by means of the main lamp control switch 1005 when using the working main lamp 10.

Further, the working main lamp 10 includes a second frame body 1006 for supporting the working main lamp 10, and the second frame body 1006 includes a base connecting piece 10061 and a base 10062, where the base connecting piece 10061 is hinged to the working main lamp 10, and the base 10062 is arranged on the base connecting piece 10061.

With the above structure, when in use, the working main lamp 10 is made to stand on the placement surface by means of the base 10062; and the angle of the light-emitting direction of the working main lamp 10 is adjusted by rotating the base connecting piece 10061.

Specifically, the base connecting piece 10061 is in a U-shaped structure, and the two ends of the base connecting piece 10061 are respectively hinged to the two sides of the working main lamp 10; more specifically, two second adjusting screw holes 1007 and two second adjusting bolts 1008 matched with the second adjusting screw holes 1007 are respectively provided at the two sides of the working main lamp 10; the second adjusting bolts 1008 respectively pass through through holes reserved on both ends of the base connecting piece 10061 and then are screwed into the corresponding second adjusting screw holes 1007; and when in use, the user rotates the second adjusting bolts 1008 to loose and tighten the base connecting piece 10061 so as to achieve adjustment and stabilization.

The base connecting piece 10061 is fixed to the base 10062 by means of a third adjusting bolt 1009, which enables the user to adjust the rotation angle between the base 10062 and the base connecting piece 10061 by adjusting the degree of tightness of the third adjusting bolt 1009, thus achieving the light-emitting direction of the working main lamp 10.

Further, the working main lamp 10 includes a second handle 10010 for holding the working lamp.

With the above structure, the second handle 10010 is convenient for the user to hold the working main lamp 10; and specifically, the second handle 10010 is in a U-shaped structure, and two ends of the second handle 10010 are connected to the working main lamp 10.

Further, a second heat dissipation device 10011 is arranged on the outer side of the main lamp housing 1001.

With the above structural surface, the second heat dissipation device 10011 improves the heat dissipation performance of the working main lamp 10. Specifically, the main lamp lighting assembly 1002 abuts against the inner surface of the main lamp housing 1001, the second heat dissipation device 10011 is disposed at a position corresponding to the abutting position of the main lamp lighting assembly 1002, and the second heat dissipation device 10011 is composed of heat dissipation fins.

Further, cable storage pieces 1102 are arranged on the outer sides of the working lamp housings 1 of the working expansion lamps 11; the two cable storage pieces 1102 are arranged opposite to each other on both sides of the back sides of the working lamp housings 1 of the working expansion lamps 11; the cable storage pieces 1102 are convenient for storing power cables 1103 connected to the working lamp input terminals 1101; cable fixing pieces 10012 are arranged on the outer side of the main lamp housing 1001 of the working main lamp 10, and the cable fixing pieces 10012 are used for fixing the power cables 1103 connected to the working lamp input terminals 1101; and specifically, the two cable fixing pieces 10012 are arranged opposite to each other on both sides of the back side of the main lamp housing 1001, and correspond to the two working expansion lamps 11.

The above descriptions are only exemplary implementations of the present invention, and it should be pointed out that, for those skilled in the art, several improvements and embellishments can be made without departing from the technical principle of the present invention. These improvements and embellishments shall also be regarded as the protection scope of the present invention.

What is claimed is:

1. A working lamp, comprising:

a working lamp housing;

a working lamp lighting assembly arranged inside the working lamp housing; and a working lamp power supply system used for supplying energy for the working lamp lighting assembly;

wherein a working lamp connecting portion is provided on an outer wall of the working lamp housing, and the working lamp housing is detachably connected to other working lamps by means of the working lamp connecting portion;

wherein the working lamp connecting portion comprises a first connecting portion connected to the working lamp housing and a second connecting portion for connection with the other working lamps;

the first connecting portion is detachably connected to the second connecting portion; and the first connecting portion is rotatably connected to the second connecting portion;

the first connecting portion comprises a connecting block connected to the working lamp housing, and a connecting rotation shaft arranged on the connecting block;

the second connecting portion comprises a connecting cylinder having a rotation shaft hole;

the connecting rotation shaft is matched with the rotation shaft hole to penetrate into the rotation shaft hole;

the connecting cylinder comprises a first connecting cylinder having a first rotation shaft hole and a second connecting cylinder having a second rotation shaft hole;

the first connecting cylinder and the second connecting cylinder are spaced apart to form a limiting gap, and the first rotation shaft hole and the second rotation shaft hole are reserved in a coaxial manner to form the rotation shaft hole;

an entry opening is reserved on a side wall of the first connecting cylinder;

the entry opening runs through the height of the first connecting cylinder in the height direction, and communicates with a connecting hole of the first rotation shaft hole in the depth direction;

the two opposite sides of the entry opening can be close to and away from each other to adjust the opening size, and the opening size of the entry opening is smaller than the diameter of the connecting rotation shaft under normal conditions; and a limiting block is arranged on a side wall of the connecting rotation shaft, the thickness of the limiting block matches the limiting gap, and the widths of at least some parts of the limiting block are greater than the opening size of the entry opening under normal conditions.

2. The working lamp according to claim 1, wherein: the limiting block is connected to the working lamp housing; the limiting block comprises a first limiting portion and a second limiting portion, one end of the first limiting portion is connected to the side wall of the connecting rotation shaft, and the other end of the first limiting portion is connected to the second limiting portion; and the width of the first limiting portion is not greater than the opening size of the entry opening under normal conditions, and the width of the second limiting portion is greater than the opening size of the entry opening under normal conditions.

3. The working lamp according to claim 1, wherein: along the direction from the end of the connecting rotation shaft connected to the connecting block to the end of the connecting rotation shaft away from the connecting block, the side wall at the end of the connecting rotation shaft away from the connecting block is obliquely closed up towards the axis of the connecting rotation shaft to form a first guide surface; and along the direction from the end of the entry opening close to the second connecting cylinder to the end of the entry opening away from the second connecting cylinder, the two opposite sides of the end of the entry opening away from the second connecting cylinder gradually get away from each other and tilt to form a second guide surface.

4. The working lamp according to claim 1, wherein: the working lamp comprises a working lamp control switch, and the working lamp control switch is connected to the working lamp lighting assembly to control the working state of the working lamp lighting assembly; the working lamp comprises a first frame body for supporting the working lamp, and the first frame body comprises a first holder and a second holder, the first holder and the second holder are separately hinged to the working lamp housing; the working lamp comprises a first handle for holding the working lamp, and the first handle is hinged to the working lamp housing; and a first heat dissipation device is arranged on the outer side of the working lamp housing.

5. A working lamp group, comprising a working main lamp and at least one working expansion lamp for expanding the working main lamp, wherein the working main lamp comprises a main lamp housing, a main lamp lighting assembly arranged inside the main lamp housing, and a main lamp power supply system used for supplying energy for the main lamp lighting assembly; and the working main lamp is formed into the at least one working expansion lamp;

and wherein a working lamp connecting portion is provided on an outer wall of the working main lamp housing, and the working main lamp housing is detachably connected to the working expansion lamp by means of the working lamp connecting portion;

wherein the working lamp connecting portion comprises a first connecting portion connected to the working main lamp housing and a second connecting portion for connection with the expansion lamps;

the first connecting portion is detachably connected to the second connecting portion; and the first connecting portion is rotatably connected to the second connecting portion;

the first connecting portion comprises a connecting block connected to the working main lamp housing, and a connecting rotation shaft arranged on the connecting block;

the second connecting portion comprises a connecting cylinder having a rotation shaft hole;

the connecting rotation shaft is matched with the rotation shaft hole to penetrate into the rotation shaft hole;

the connecting cylinder comprises a first connecting cylinder having a first rotation shaft hole and a second connecting cylinder having a second rotation shaft hole;

the first connecting cylinder and the second connecting cylinder are spaced apart to form a limiting gap, and the first rotation shaft hole and the second rotation shaft hole are reserved in a coaxial manner to form the rotation shaft hole;

an entry opening is reserved on a side wall of the first connecting cylinder;

the entry opening runs through the height of the first connecting cylinder in the height direction, and communicates with a connecting hole of the first rotation shaft hole in the depth direction;

the two opposite sides of the entry opening can be close to and away from each other to adjust the opening size, and the opening size of the entry opening is smaller than the diameter of the connecting rotation shaft under normal conditions; and a limiting block is arranged on a side wall of the connecting rotation shaft, the thickness of the limiting block matches the limiting gap, and the widths of at least some parts of the limiting block are greater than the opening size of the entry opening under normal conditions.

6. The working lamp group according to claim 5, wherein: the working main lamp comprises an energy supply output terminal used for providing electric energy for the working expansion lamp, and the energy supply output terminal is electrically connected to the main lamp power supply system to obtain electric energy; the working lamp power supply system in the working expansion lamp comprises a working lamp input terminal which can be electrically connected to the energy supply output terminal to obtain electric energy; the main lamp power supply system comprises a main lamp input terminal; the main lamp input terminal can be matched with and electrically connected to a mains supply output terminal connected to a mains supply to obtain electrical energy; and the working lamp input terminal can be matched with and electrically connected to the mains supply output terminal connected to the mains supply to obtain electrical energy.

7. The working lamp group according to claim 6, wherein: the two working expansion lamps may be provided and are respectively arranged on both sides of the working main lamp; and the working main lamp comprises a main lamp control switch, and the main lamp control switch is connected to the main lamp lighting assembly to control the working state of the main lamp lighting assembly.

* * * * *